United States Patent [19]

McKinzie

[11] Patent Number: 4,586,028

[45] Date of Patent: Apr. 29, 1986

[54] ALARM SYSTEM

[76] Inventor: George T. McKinzie, Rte. 5, Box 299, Rainerd, Minn. 56401

[21] Appl. No.: 512,767

[22] Filed: Jul. 11, 1983

[51] Int. Cl.[4] ..... G08B 23/00; G08B 13/08

[52] U.S. Cl. ..... 340/500; 340/63; 340/508; 340/511; 340/537; 340/546; 307/10 AT

[58] Field of Search ..... 340/500, 63, 506–511, 340/537, 650–653, 657, 660, 661–664, 541, 546, 548, 568, 571, 572; 307/10 R, 10 AT

[56] References Cited

U.S. PATENT DOCUMENTS

| | | | |
|---|---|---|---|
| 3,786,501 | 1/1974 | Marnerakis | 340/509 |
| 4,203,095 | 5/1980 | Wilson, Jr. | 340/511 |
| 4,282,517 | 8/1981 | Wilson, Jr. et al. | 340/511 |
| 4,348,661 | 9/1982 | Lucchesi | 340/510 |
| 4,369,436 | 1/1983 | Lautzenheiser | 340/511 |

*Primary Examiner*—Donnie L. Crosland
*Attorney, Agent, or Firm*—Hugh D. Jaeger

[57] ABSTRACT

Alarm system providing a signal by turning on alarms, lights, sirens, automobile horns or wake-up signal based on interruption of a monitor loop. Monitor loop includes a resistor which connects to the inputs of a low-power low-offset voltage dual comparator for providing an ON signal for turning on a buzzer alarm and also for driving a relay through a switching transistor. The relay can include normally closed and normally open contacts for operating an existing closed loop or open loop device or circuits. The alarm system also includes a line-adjust circuit for adjusting the particular resistance and the monitor loop, a latch circuit for latching the buzzer and relay in an ON position based on circuit interruption, and includes internal power source as well as provision for external power.

4 Claims, 2 Drawing Figures

ALARM SYSTEM

BACKGROUND OF THE INVENTION

1. Field of the Invention

The present invention pertains to an alarm system, and more particularly pertains to an alarm system which is portable, self-contained, and can be utilized to protect such items as homes, businesses, and, more importantly, bicycles, motorcycles, garden equipment, watercraft, motors, tools, snowmobiles, skis, trailers, and the like, whether it be at home, work, or when traveling.

2. Description of the Prior Art

Prior art alarm systems have always been fixed and have never provided for portability of the alarm. The prior art alarm circuits have always been hard-wired into position or hard-wired onto certain objects, and have never provided for flexibility away from the intended location.

Prior art alarm systems usually had foil glued to the window, various switches, magnetic switches or the like secured to doors, and other particular circuitry intended which was wired into an alarm panel. The prior art systems were always fixed capital expenditures and never provided for any use other than that intended as installed.

The prior art has always been evoid of portable alarm systems such as those which can be utilized when an individual is traveling, on vacation, or for a variety of purposes in the home to provid an alarm signal, on the basis of an event occurring. Prior art systems have not provided a system which provides an alarm system temporary in nature which would indicate when a certain act has occurred.

The present invention overcomes the disadvantages of the prior art by providing an alarm system which is particularly useful for sport assets such as bicycles, motorcycles, garden equipment, boats, motors, tackle boxes, tools snowmobiles, skis, trailers and the like around the hme or residence or while traveling which can be hooked up with minimal effort, powered either internally or externally even from the power light socket or from the cigarette socket in a vehicle, and provides protection and indication of an alarm signal on breaking of a monitor loop circuit.

SUMMARY OF THE INVENTION

The general purpose of the present invention is to provide an alarm, herein referred to the "sport-alarm," for protecting property by turning on alarms, lights, sirens, auto horns, or providing a wake-up signal to alert one that a theft is being attempted. The alarm is practically impossible to breach, operates on either line voltage with an adapter, vehicle voltage, or can also be battery operated for portable use. The alarm system can protect bicycles, motorcycles, garden equipment, boats, motors, tackle boxes, skis, tools, snowmobiles, trailers, homes, and businesses, and can be used at home, at work, or when traveling.

According to one embodiment of the present invention there is provided an alarm system which includes low-voltage low-offset voltage dual comparators, a fixed resistance and adjustable line resistance across one input of the comparators, a monitor loop including a fixed resistance across the other input of the comparator, and an output signal which drives a switching transistor, the switching transistor connected to a relay including a normally open and a normally closed circuit, and a power source connected to the circuitry for powering the relay as well as the comparator and providing current through the monitor loop whereby a breaking of the monitor loop will provide a resistance and output signal at the comparators driving the switching transistor to actuate the relay and the normally closed and normally open circuit. A buzzer can also connect across the relay and can include a latching switch connected to the input of the comparators for latching the buzzer alarm as well as the relay in an energized position when a breach of the monitor loop occurs.

A significant aspect and feature of the present invention is an alarm system which provides a wake-up signal or signal to alert one that a theft is being attempted by breaking of the monitor loop. The monitoring loop includes a male and female automobile connector and is a wire including a resistance which can be strung through, for example, a boat, boat motor, tackle box or the like and can be hooked up to signal an alarm such as a vehicle horn or the like. The monitor loop could also go through a bicycle, snowmobile, chain:saw, tractor, or cultivator at an individual's residence and also indicate that a signal breach has occurred.

Another significant aspect and feature of the present invention is an alarm system which is useful for protecting sport items such as bicycles, motorcyles, boats, motors, tackle boxes, tools, snowmobiles, skis, trailers and the like whether an individual is on vacation, traveling, at work or at home.

Another significant aspect and feature of the present invention is an alarm system which can utilize either internal battery power, vehicle power through an adaptor, or line voltage in a residence through an adapter.

Having thus described embodiments of the present invention, it is a principal object hereof to provide an alarm system, particularly an alarm system for sporting and large capital expenditures which are often being moved or transported.

One object of the present invention is to provide an alarm system which only requires the looping of an alarm monitor cable through objects such as a boat, snowmobile, bicycle, garden tractor, chain saws or the like and then closing the monitoring loop through a plug, providing for actuating of the alarm.

Another object of the present invention is an alarm which can be easily utilized by any individual and only requires for the looping of the monitoring cable of any length through any number of objects and can be easily actuated by one switch to provide for an alarm whether the alarm box be positioned in a home, a hotel room, out on a campground, or many hundreds of feet away from the device being protected.

A further object of the present invention is an alarm system which can be either hard-wired in for protecting portions of the home or temporarily wired such as when an individual is traveling, at a vacation location or on the road.

An additional object of the present invention is an alarm system which is portable, self-contained, and can actuate normally open and normally closed circuits such as automobile horns for normally open and normally closed other existing closed looped alarm circuits in series with this alarm circuit.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
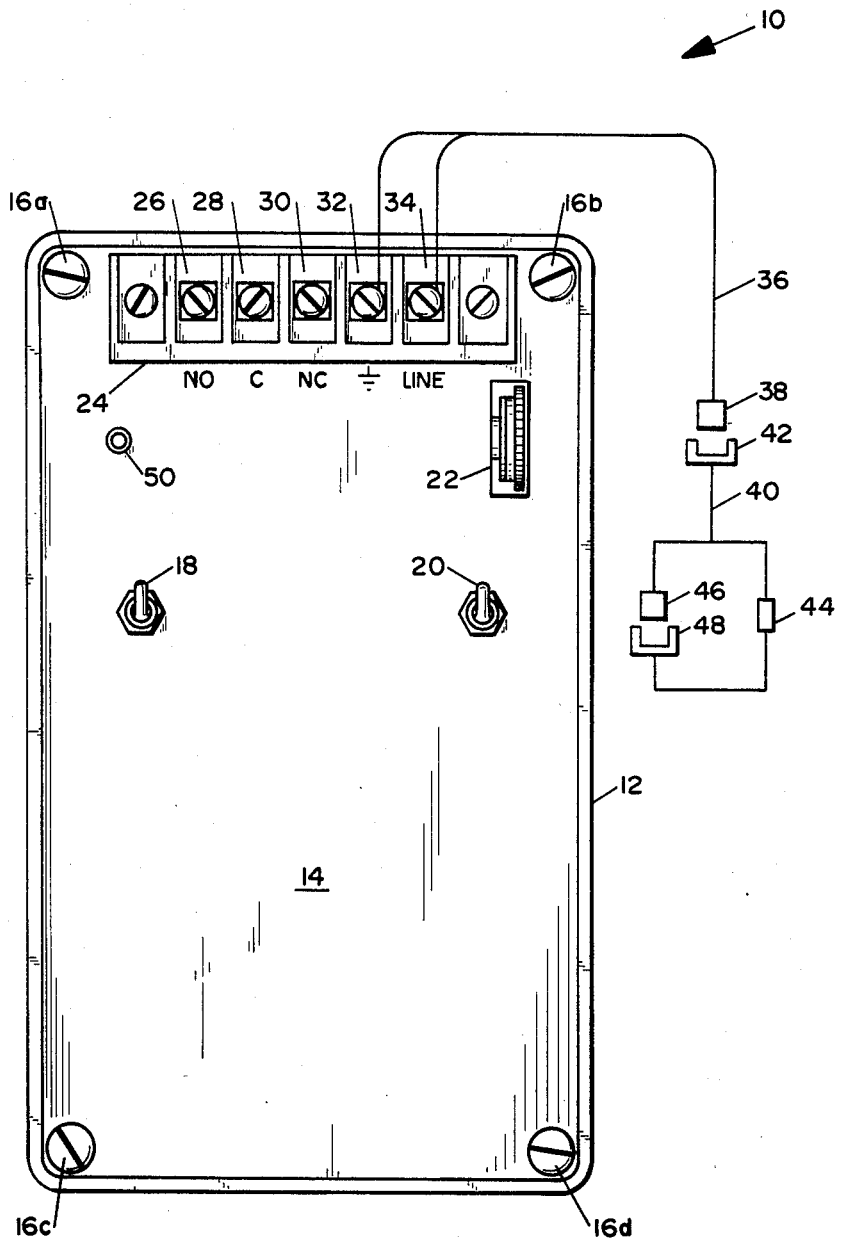
FIG. 1 illustrates a plan view of the alarm system, the present invention, including the housing front panel; and, FIG. 2 illustrates an electrical circuit schematic diagram of the alarm system.

FIG. 1 illustrates a plan view of an alarm system 10, the present invention, also designated as "sport-alarm," including a five-sided housing 12 such as a plastic box or the like with a top panel 14 secured by screws 16*a*–16*d*. The top panel includes silk-screened lettering and designations and includes an ON/OFF switch 18, a latch-normal switch 20, a line-adjust variable resistor 22, and a wiring block 24. The wiring block includes from left to right a normally open connection 26, a ground common connection 28, a normally closed connection 30, a ground or circuit return 32, and a resistive line monitor loop connection 34. The monitor lead cable 36 of two conductors connects to the ground or circuit return 32 and the resistive line 34 and includes a male plug 38 at the other end thereof. A monitor loop cable 40 includes a female plug 42, a loop resistor 44, and a male and female plug such as an automobile electrical plug 46 and 48 for providing connection of the loop of the two wire ends. A power input jack 50 is provided on the panel 14.

Figure 2:
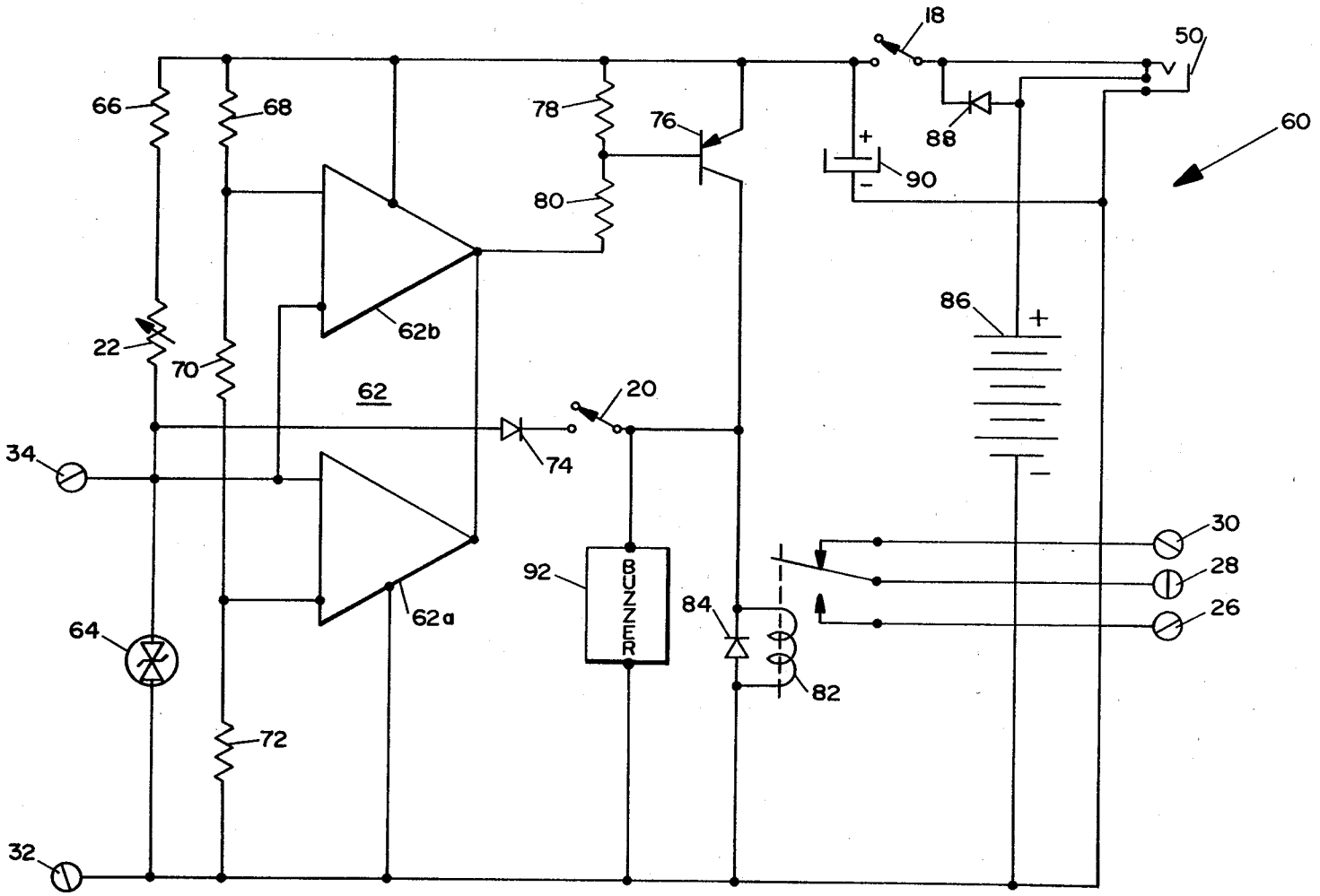

FIG. 2 illustrates an electrical circuit schematic diagram 60 of the alarm system 10. The integrated circuit 62 is a low-power low-offset voltage dual comparator including a monitor loop section 62*a* and a line adjust section 62*b*. In this particular example, by way of illustration only and not to be construed as limiting of the present invention, a National semiconductor LM393 voltage comparator is utilized. All previous numerals correspond to those as described for FIG. 1. A transient supressor 64 is provided across the input of the monitor loop section 62*a*. The line adjust resistor 22 and fixed resistor 66 are provided across the input section of IC 62*b*. Resistors 68, 70 and 72 are biasing resistors. Latching diode 74 operates in conjunction with switch 20 as later described in detail. Resistors 78 and 80 are biasing resistors connecting between the output of the IC section 62*b* and the base of the switching transistor 76. A relay 82 connects between the collector of switching transistor 76 and ground. A transient diode 84 connects across the coil of the relay. The relay includes normally open and normally closed contacts, as previously described. A battery 86 connects between the switch 18 and ground. A diode 88 and capacitor 90 are provided for the external power source 50. A buzzer 92 connects across the collector of the switching transistor 76 and ground.

MODE OF OPERATION

The alarm system 10 operates by connecting the monitor lead cable to the appropriate ground terminal and line terminal. This resistance should not exceed a predetermined resistance such as 1000 ohms. The monitor loop cable is then connected to whatever objects are desired to be protected and such, as in this instance, is looped through boats, motors, tackle boxes, fishing rods, bicycles, snowmobiles, chain saws, garden tractors, lawnmowers, garden cultivators, or hard-wired to alarm protection devices such as door switches, window systems or the like.

Usually what happens in a situation of this type of alarm usage is that the alarm can be used with boats, motors, or trailers and the wire is strung between the several, and if a theft is attempted the wire is usually cut or broken, such as by pulling of the device. The principle of operation is that law enforcement officers are of the distinct feeling that if the alarm wire is strung in open view, people will be less likely to touch one's property or in the alternative will cut the cable, resulting in the sending of an alarm.

The alarm system 10 can be positioned either in a vehicle and connected to the cigarette lighter and also to the horn of the vehicle, or can be positioned in a mobile home or van or inside one's house or cabin.

When an alarm condition is sensed, the internal buzzer will sound whether the alarm is powered off battery power or, in the alternative, is powered off auxiliary power such as line voltage or vehicle voltage. The buzzer will sound and can be latched into position through the normal-latch switch. In the alternative, the normally open and normally closed contacts can be connected to a car horn, light, siren or the like where the normally closed contacts can connect to an existing alarm, for example such as a closed-loop alarm circuit can be connected in series therewith.

The ON/OFF switch provides that items can be removed from the alarm system only through operation at the alarm housing 10. The latch normal switch provides that the alarm can be latched on when a breach occurs or can only signal during such time that the breach occurs. The line adjust provides for variances in the system and includes for any additional amount of wiring resistanee through the circuit which cannot exceed a predetermined value which is 1000 ohms in this example.

The application of this alarm system 10 lends itself to alarming of sport items as well as general items. The Sport-Alarm is intended to meet the long felt need for an alarm system by citizens and law enforcement officials in protecting of property which previously had not been protected, particularly vehicles and trailers on the road. In this particular instance, the loop is threaded through the item such as the trailer, boat, motor, fishing gear, snowmobile, or other item, and the alarm can be wired to the vehicle horn, etc.

The alarm system 10 can also be utilized commerically where the latch diode, latch switch, buzzer, and battery are omitted as these elements are found in commerical and industrial alarm systems. This alarm is known as the Extra Guard Alarm for use in being hard wired into the existing alarm system.

Various modifications can be made to the present invention without departing from the apparent scope thereof. For instance, other integrated circuits can be substituted for that of the voltage comparator as disclosed. Also, the mechanical configuration can be varied from that as disclosed.

Having thus described the invention, what is claimed is:

1. Alarm system for protection of sport accessories including bicycles, motorcycles, boats, motors, snowmobiles, and intended for use at home, at work, on vacation or when traveling comprising:

a. integrated circuit low-power low-offset dual voltage comparators including separate inputs, one of said comparators as a monitor comparator, said input of said monitor comparators for connection to a monitoring loop;

b. a variable line adjustment means connected across said input of the other of said comparators as a line adjust comparator;

c. a monitor lead cable including a monitor loop and including a predetermined resistance through a resistor and length of wire in said monitor loop, and including an automobile connector means along a length of said loop for connection through said sport accessories to an input of said monitor loop comparator;

d. the output of said comparators connected to a switching transistor;

e. a relay including normally closed contacts, common, and normally open contacts connected between said switching transistor and ground;

f. alarm means connected to said switching transistor;

g. a latch means connected between a node of said alarm means, and said switching transistor and said relay and said input of said comparators;

h. power source means connected across said switching transistor and said relay; and, i. housing means for enclosing said alarm system and including a panel for supporting a wiring block, said wiring block including terminal connections for line, ground, normally open, and normally closed terminals, said panel supporting said line and said ground terminal connections for said monitor lead cable and wired to one of said dual voltage comparators and said normally open, common and normally closed terminals connections connected to said relay, an auxiliary power input connected between, an ON/OFF switch, line-adjust switch, and latch-normal switch whereby said alarm system is utilizable in either a fixed or remote location, and can be powered by said power means internally or externally, and provides an internal alarm signal as well as said normally open and said normally closed connections for external switched alarm signals, thereby providing an alarm system for sport items.

2. Alarm system of claim 1 including normally open and normally closed contacts of a relay connected to said alarm means for connection to external alarm circuits.

3. Alarm system of claim 1 wherein said alarm means comprises a buzzer.

4. Alarm system of claim 1 wherein said power means includes an internal battery.

* * * * *